US006287612B1

(12) United States Patent
Mandava et al.

(10) Patent No.: US 6,287,612 B1
(45) Date of Patent: Sep. 11, 2001

(54) LIQUID FOOD PRODUCTS AND PACKAGE THEREFORE

(75) Inventors: Rao Mandava, Helsingborg; Klaus Kempin, Bjuv; Jorgen Holm, Helsingborg, all of (SE)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/447,861

(22) Filed: Nov. 23, 1999

Related U.S. Application Data

(60) Provisional application No. 60/110,561, filed on Dec. 1, 1998.

(51) Int. Cl.[7] ..... A21D 10/02; B65D 85/22

(52) U.S. Cl. ..... 426/120; 426/618; 206/568; 222/94

(58) Field of Search ..... 426/120, 73, 122, 426/618, 265, 580, 641; 206/568; 383/38; 222/94, 153.06

(56) References Cited

U.S. PATENT DOCUMENTS

| | | | | |
|---|---|---|---|---|
| 2,739,751 | * | 3/1956 | Bailey | 220/522 |
| 3,651,615 | | 3/1972 | Bohner et al. | 53/28 |
| 3,795,081 | | 3/1974 | Brown, Jr. et al. | 53/28 |
| 3,871,559 | * | 3/1975 | Smith et al. | 222/183 |
| 3,892,058 | * | 7/1975 | Komatsu et al. | 53/21 |
| 4,488,647 | | 12/1984 | Davis | 206/525 |
| 4,518,087 | | 5/1985 | Goglio | 206/632 |
| 4,667,453 | | 5/1987 | Goglio | 53/415 |
| 4,705,174 | | 11/1987 | Goglio | 206/632 |
| 4,823,985 | * | 4/1989 | Grollier et al. | 222/1 |
| 4,830,868 | * | 5/1989 | Wade et al. | 426/565 |
| 4,844,917 | * | 7/1989 | DeLorimiere | 426/87 |
| 4,869,915 | * | 9/1989 | Inayoshi et al. | 426/565 |
| 4,953,709 | | 9/1990 | Kaufmann | 209/44 |
| 5,038,550 | * | 8/1991 | Wirsig et al. | 53/451 |
| 5,723,162 | * | 3/1998 | Whalen et al. | 426/28 |

FOREIGN PATENT DOCUMENTS

| | | |
|---|---|---|
| 42 19 598 A1 | 12/1993 | (DE) . |
| 0 657 367 A2 | 6/1995 | (EP) . |
| 95/01287 | 1/1995 | (WO) . |
| 98/26997 | 6/1998 | (WO) . |

OTHER PUBLICATIONS

Mill Milk Research Article, Rytter et al., http://www.mill-milk.com/research.htm, page 1, best date=, Oct. 1997.*
Mill Milk Website Homepage, http://millmilk.com, pps. 2,5,7–8, & 13, best available date=, Oct. 1998.*

* cited by examiner

*Primary Examiner*—Milton Cano
*Assistant Examiner*—Sherry A. Daverman
(74) *Attorney, Agent, or Firm*—Winston & Strawn

(57) ABSTRACT

An article of manufacture that combines a squeezable food product and a packaging unit for storing and consuming of the food product. The squeezable food product includes a first food component forming a base component and a second food component forming a filling component. The first food component and the second food component form a combinable food product upon consumption having sensory and nutritive properties close to a solid metal. The packaging unit is a supple pouch having a main external squeezable body and at least one partition layer which divides the squeezable body into at least two separate cavities. The first and second food components are separately stored in different cavities. On extrusion and recombination, the two food components are perceivable as two different components.

13 Claims, 3 Drawing Sheets

LIQUID FOOD PRODUCTS AND PACKAGE THEREFORE

RELATED APPLICATION

This application claims the benefit of U.S. Provisional Appl'n. No. 60/110,561, filed Dec. 1, 1998.

TECHNICAL FIELD

The invention relates to liquid and squeezable food products and a squeezable package for use in consuming such products.

BACKGROUND OF THE INVENTION

A variety of snack and/or dessert food products packaged in squeezable containers are known in the art. For example, Kraft Foods of Glenview, Ill. offers a squeezable gelatin and pudding product line. In like manner, Energy Zone of Westlake Village, Calif., produces a line of squeezable gelatin, pudding and applesauce varieties. Further, General Mills has recently introduced a yogurt product packaged within a tube that can be served refrigerated, frozen or thawed.

A variety of double-compartment package configurations are known in the art. For example, German Patent Publication No. DE 1 511 942 discloses a two-compartment package formed from three parallel films, but consumption of a squeezable combination of two different but complementary food products at the same time is not intended.

U.S. Pat. No. 3,651,615 discloses a sealed package formed of metal-foil-polyethylene having two compartments designed to have a lubricant or other material enclosed in one compartment, and a catheter or other medical or surgical device in the other compartment. A rupturable ultrasonic seal is provided between the compartment so that the catheter or the like has its tip and least adjacent portions covered with lubricant at the time of the use. The consumption of food products with such a package is not intended and would not be appropriate.

Further, U.S. Pat. No. 3,795,081 discloses a cylindrical package forming compartmented portions. The package may contain chemical materials which when united form mixtures containing reactive components. It is not intended to serve a foodstuff by using such a package.

As noted above, prior art squeezable foods are mainly of the snack and/or dessert variety. Moreover, the snack and/or dessert of the prior art are traditionally of a gel-like consistency, and are intended to be consumed as a simple food product or a mixture expelled from a single-compartment package. Thus there is a long-felt need, which is satisfied by the invention described herein, for convenient, nutritionally balanced liquid and squeezable foods and packages for directly delivering such squeezable foods to the consumer without requiring knives, spoons or other eating utensils. There is also a need to provide a squeezable foodstuff having sensory and nutritive properties identical or close to a complete solid food or meal, and this is also provided by the present invention.

SUMMARY OF THE INVENTION

The invention relates to novel liquid food products. A first embodiment of these products is directed to a drinkable liquid food product. The primary ingredient of the drinkable liquid food products of the invention is oat milk. Oat milk is an important source of beta-glucan and has been approved by the U.S. Food and Drug Administration for its cholesterol-lowering properties. It is presumed that oat milk participates to the reduction of coronary heart diseases. Additional ingredients, such as fruit puree, fruit pieces, nuts, cereals, cookie crumbs, vegetables and/or tapioca starch granules, or mixtures thereof, may if desired, be combined with the oat milk component to provide the resultant drinkable products with a variety of textures and/or tastes.

A second embodiment of the invention relates to a multi-component combinable squeezable substantially liquid food product having the sensory and nutritive properties close to solid food or meal upon recombination.

More specifically, the squeezable food products comprises (1) a first food component forming a base component and (2) a second food component combinable with the first component to form a complete food upon consumption. More preferably, the first component is a cereal-based component whereas the second component is a filling component.

DETAILED DESCRIPTION OF THE INVENTION

Figure 1:
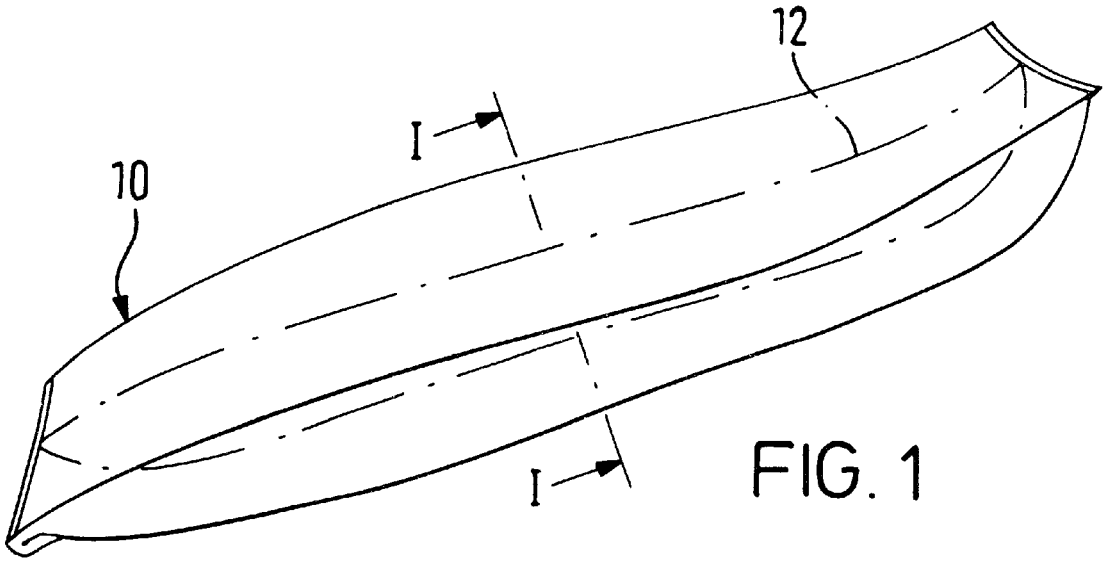
FIG. 1 is a perspective view of a squeezable food package pouch constructed according to the invention.

The invention relates, as noted above, to a variety of formulations comprising drinkable and squeezable liquid food products. Turning first to the drinkable products, Table 1 below sets forth the recipes for six drinkable products produced according to the invention. The first five of these products, i.e., strawberry, apricot, pineapple, exotic fruits and chocolate, are relatively sweet drinks while the sixth formulation, i.e., vegetable, is a savory-type drink. The drinkable products disclosed in Table 1 vary in texture from entirely liquid to a liquid containing solid particles, such as fruit pieces, nuts, cereals, vegetables and/or tapioca starch granules.

All five of the sweet drinks were adjusted as shown in Table 2, to provide the recommended nutritional requirements conducive to good health. As shown, these drinks provide an energy content of 1/Kcal/g with less than 30%, preferably less than 20%, of the energy coming from fat, with about 10% of the energy coming from protein and the balance, i.e., about 60%, from carbohydrates. Each formulation contains at least 0.65 grams, preferably about 0.75 g per portion or serving of beta-glucans and at least 3.5 g per portion of total fiber. A portion is typically about 275 grams. The drink is also low or free in total and saturated fats and cholesterols. The drinks were fortified with Vitamin C in an amount of 50 mg per portion. Although other nutrients such as calcium, iron and Vitamins A, D and E were not balanced, this could be done during the fortification step if desired. All of these drinkable products were rated high in sensory quality during testing.

In the squeezable food products of the invention, the cereal-based component is preferably a material such as bread, corn chips, cookies, cereal flakes, cereal flour, rice or lentils, as well as mixtures thereof. Other preferred components include starchy cereal-like materials such as potatoes and vegetables. The cereal-based component has to be in a substantially liquid or semi-solid form in order to be extruded out by squeezing effect. The term "semi-solid" may be understood as meaning a mixture or combination of small solid pieces such bread crumbs or flour, in a water-based and/or fat-based liquid matrix which is easily extrudable or dispensable by the force of a user's hand. In this semi-solid form, the solid component may be present in proportions greater than the liquid component.

The term "squeezable" is understood as meaning the product is readily deformable, extrudable and dispensable under the modest force a consumer would apply by hand to a flexible food-containing plastic container.

Preferably, the first food component may advantageously comprise a source of beta-glucan. The source of beta-glucan is preferably oat milk.

The filling component comprises a food material chosen among a sauce such as a meat or vegetable sauce, fruit puree or fruit pieces, a spicy blend such as Mexican blend, ratatouille or combination thereof. The filling may comprise solid particles or pieces of meat and/or vegetable and/or fruit in a liquid matrix. The size of the particles or pieces must not exceed a reasonable size in order to allow them to pass through the outlet of the package during squeezing. In general, solid pieces of about 5 mm or less, preferably about 1 mm or less, are appropriate.

The base component and the filling component are combinable upon consumption so as to provide a substantially liquid food which has sensory and nutritive properties close to a solid meal. The base and filling are stored separately in order to provide upon consumption a combination of food product that the consumer can perceive as a complex food preparation. If a multi-component food product is stored together in the same compartment, the consumer would not be capable to differentiate the combination but would perceive a mere mixture of food products with lower organoleptic and sensory properties.

The base component and the filling component are also stored separately to prevent undesired contact between them and also permit the application of individually adapted conservative treatment. In particular, the cereal-based component has preferably a pH value higher than the pH value of the filling which makes the combination of both in the same cavity undesirable. More specifically, the cereal-based component has a pH comprised between 5 to 6, whereas the filling component has a pH comprised between 5.5 to 4.3. The acidity of the filling component would deteriorate the taste, flavor, texture and appearance of the cereal-based component in a very short period if combined into the same compartment. Moreover, the cereal-based component may have to be submitted to a sterilization treatment due to a lower natural acidity than the filling component. The filling component may so experience a milder heat treatment such as only a high pasteurization.

Similarly, the filling advantageously comprises a water content that is higher than the water content of the base component. The water content of the filling component ranges from 40 to 90% by weight. The base component has a water content lower than 90% by weight, preferably comprised between 5 to 75% by weight. The filling has the function to "wet" the base component, as it would do in a regular solid meal. The separate packaging permits the variation of water content of each component until the two components are released. If the component were mixed into the same compartment, such water differentiation would not be possible. The variation of water content may also serve to vary the degree of extrusion of the components. In particular, the filling will have a tendency to expel more rapidly from the package compared to the base component. For example, the extrusion rate between base: filling can vary from 1:1 to 1:3. This may be advantageous when the meal is to be reconstituted directly in the mouth as more filling may be required relative to the base component. Of course, the extrusion rate will also depend upon the size of the outlet for each compartment of the package which can be variable. In an alternative, it may be envisioned to have a higher extruded mass of base relative to the filling.

The squeezable combinable food product is preferably associated to an appropriate packaging unit used for storing and consuming of the food product. Therefore, the squeezable food product is typically packaged in single-serving portions.

The packaging unit comprises a supple pouch having a main external squeezable body and at least one partition layer which divides the squeezable body in at least two separate and impervious cavities. The cavities are designed to receive and provide appropriate storage to the one of the food components of the food product; i.e., the base component and the filling component, as aforementioned.

The packaging unit is preferably an elongated unit in which the two cavities are positioned in an adjacent relationship one from the other, at least up to the opening region intended for being opened for consumption. Therefore, the opening region is torn off so as to allow recombination of the two components into a dish or directly within the mouth of the consumer who can have the feeling of eating a complete foodstuff with complementary sensory and nutritive properties.

The packaging unit preferably comprises a plastic pouch with a barrier layer, preferably also formed of plastic, separating the two food components. The barrier layer prevents mixing of the base and the filling when the product is stored. Furthermore, by preventing such contact, it is possible to separately process one of the food components within the package under conditions which would otherwise be deleterious or damaging to the other food component, such as by varying the pH, water activity and/or by heat treatment. The result is a product having a significant degree of shelf stability, as well as a desirable energy density and a recommended content of fiber and beta-glucan.

When one desires to consume the squeezable substantially liquid food product within the plastic pouch, one need only open the base and/or filling compartments and squeeze the pouch to release the contents therefrom, e.g., onto a plate or dish or directly into the mouth. No specific preparation before the consumption is needed. The package contents provide a well balanced, nourishing snack or meal which satisfies the consumer's hunger and which tastes good even at room temperature. Moreover, unlike other types of solid foods, the liquid foods contemplated herein can be readily consumed without the need for water or some other beverage to wash them down. The package may optionally be warmed or heated before consumption during several seconds in microwave or in boiling water. The product may also be consumed in chilled or ambient conditions.

Turning now to preferred examples of the squeezable substantially liquid products of the invention, six recipes were prepared, including four savory products and two sweet products, as shown in Tables 3–8 below. Each product comprises a base component and a filling component. The base component comprises preferably at least a cereal-based material. As shown in the Example, the base component was made up with oat milk combined with materials such as white bread (Grissini), crackers, corn chips, butter cookies, bulgur, lentils, and potatoes. The base component could also comprise other cereals such as rice or more refined cereal-based components such as pasta. In one example, corn chips were ground into a coarse powder and then mixed with oat milk and salt to form a base. A variety of savory fillings, using food combinations such as ham and tomato, spicy Mexican, meat sauce and ratatouille, were prepared. In addition, two types of sweet fillings, based on fruits, were also prepared. The base component and the filling component were then placed within two separate compartments in a plastic pouch separated by a plastic barrier. The squeezable plastic container may be opened, for example, by cutting or tearing, e.g., along a perforated line. Alternately it may be provided with an easy opening spout arrangement in a manner well-known to those of ordinary skill in the art.

The savory product (pizza and ham) of Table 3 and a sweet product (cookies and marmalade)of Table 7 were balanced for nutrition as shown in Table 9. As shown in Table 9, these products provide good nutrient density with less than 30% of their energy being provided by fat, with about 10% coming from protein and about 60% from carbohydrates. These compositions, in addition, possess the required levels of fiber and beta-glucans. If desired, they could also be fortified with a variety of minerals and/or vitamins.

FIG. 1 illustrates a squeezable food package pouch 10 constructed according to the invention. Pouch 10 is provided with a partition layer such as a barrier layer 12 configured and adapted to help to separate the base component and the filling component of a squeezable liquid food product according to the invention. The packaging unit is openable along an opening line which encompasses both a portion of the first and second cavities so that the two food components can be extruded together to constitute a complete food product.

Figure 2:
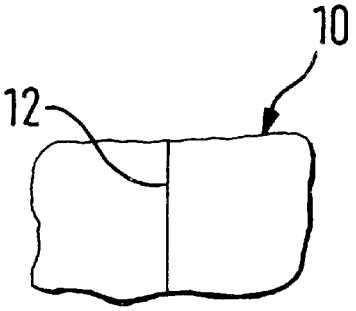
FIG. 2 is a sectional view through the squeezable food package of the invention along line I—I of FIG. 1.

FIG. 2 is a side view of the package of FIG. 1 along with the plane I—I depicted in FIG. 1.

Figure 3:
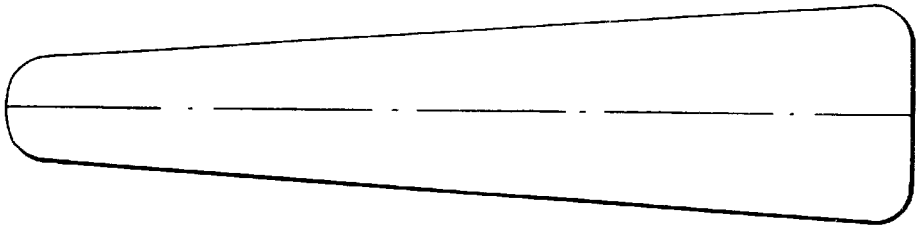
FIG. 3 is a side view of a squeezable food package constructing according to a variant of the invention.
Figure 4:
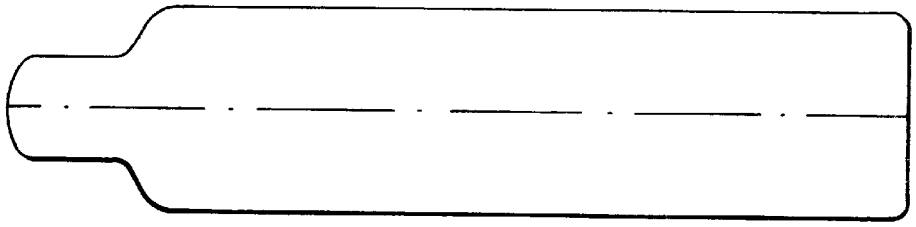
FIG. 4 is a second variant of FIG. 3.
Figure 5:
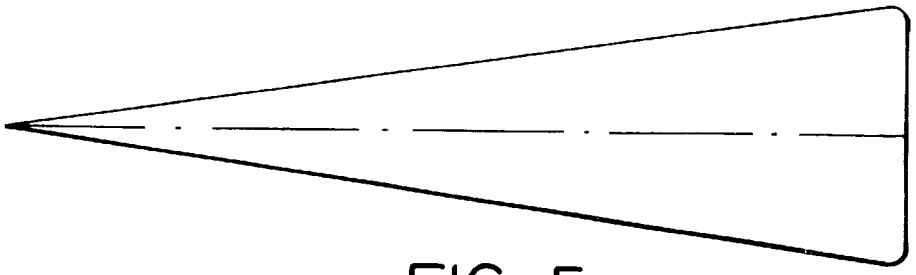
FIG. 5 is a third variant of FIG. 3.

FIGS. 3 and 4 show various examples in which the opening end is made narrower with respect to the rest of the package so as to facilitate the squeezability into the mouth and favor the recombination of the food into the mouth. FIG. 3 shows a substantially trunconical shape. FIG. 4 shows a cylindrical body with an end zone having a lower section corresponding to the opening region. FIG. 5 shows a continuous tapered body which terminates by a thin end corresponding to the opening region.

Figure 6:
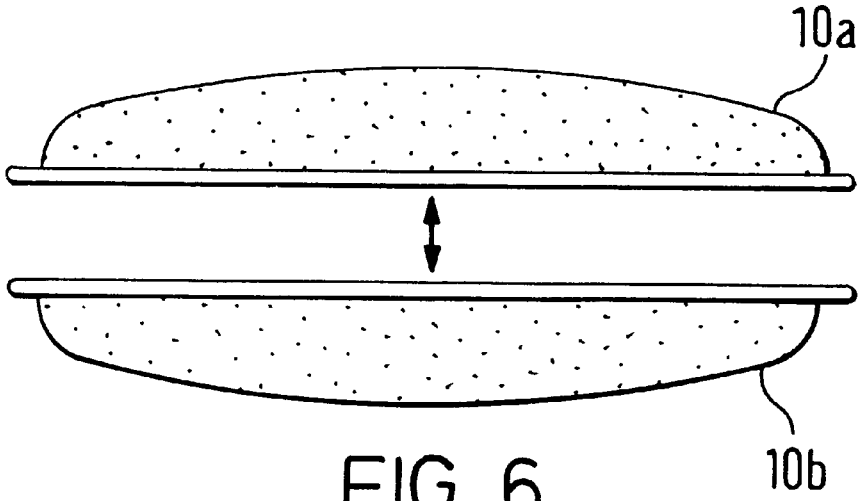
FIG. 6 shows the assembling operation of a dual compartment package.
Figure 7:
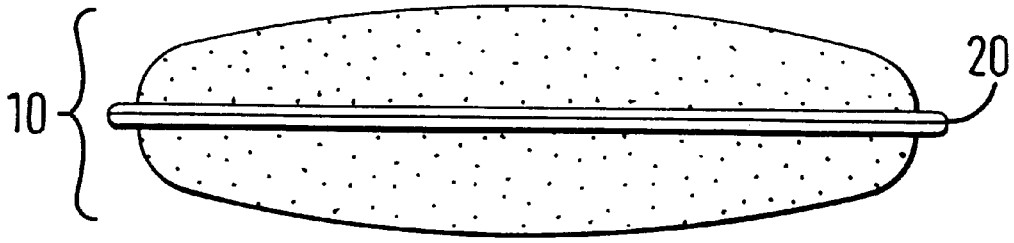
FIG. 7 is the result of FIG. 6 after sealing.

The dual compartment package may be produced by assembling two compartments which have been previously filled with their respective liquid food component as shown in FIGS. 6 and 7. A first compartment 10*a* is filled with a cereal-based component using the well known form/fill/seal technique. A second compartment 10*b* is filled with the filling component in a similar manner. After that, a selective heat treatment can be carried out on each compartment separately depending upon the desired conditions required for preservation. For instance, compartment 10*a* may comprise small sized pasta such as Risoni which has a pH of about 5.5 and hence needs to be heat treated by sterilization at about 121° C. during for a period ranging from several seconds to several minutes. The second compartment may advantageously comprise Italian tomato sauce with meat and/or vegetable pieces which is more acidic (pH about 4.4) and therefore requires just a high pasteurization of 95° C. during for a period of about 10 minutes. After heat treatment, the two compartments are sealed together along a protruding seal edge 20 so as to form a single package having two continuous arranged compartments. The compartment may have a substantially half-moon shape with a flat interior surface to facilitate the assembling. Sealing can be carried out by ultrasonic device, for example, or by any other suitable technique. For example, the interior contact surfaces of the two compartments may be assembled together by gluing.

In the present invention, the packaging unit may be formed of plastic sheets or laminates. Suitable materials include metallic foils, thermoplastic films, papers, and combinations thereof. More preferably, the sheet material may be a coextruded laminate comprising OPP (external/Alumininum/Polypropylene (internal). OPP means especially oriented polypropylene. Examples of laminate thickness distribution are 20/9/30–70 microns.

While the foregoing description and drawings represent the preferred embodiments of the present invention, it will be understood that various additions and/or substitutions may be made therein without departing from the spirit and scope of the present invention. For instance, the products could also be stored and consumed as a chilled product, if necessary. One skilled in the art will appreciate that the invention may be used with many modifications of structure, forms, arrangement, proportions, materials, and components and otherwise, used in the practice of the invention and which are particularly adapted to specific environments and operative requirements, without departing from the principles of the present invention. The presently disclosed embodiments are therefore to be considered in all respects as illustrative and not restrictive.

TABLE 1

| | Recipes (%) if drinkable products | | | | | |
|---|---|---|---|---|---|---|
| | Strawberry | Apricot | Pineapple | Exotic fruits | Chocolate | Vegetable |
| Oat milk | 74.91 | 69.32 | 66.44 | 63.87 | 79.86 | 75.95 |
| Strawberry Puree | 10.91 | | | | | |
| Apricot puree | | 10.85 | | | | |
| Pineapple puree | | | 15.32 | | | |
| Exotic fruit puree | | | | 13.66 | | |
| Tomato puree | | | | | | 10.13 |
| Celery puree | | | | | | 2.53 |
| Spinach puree | | | | | | 1.27 |
| Carrot puree | | | | | | 5.70 |

TABLE 1-continued

| Recipes (%) if drinkable products | Strawberry | Apricot | Pineapple | Exotic fruits | Chocolate | Vegetable |
|---|---|---|---|---|---|---|
| Carrot pieces | | | | | | 1.90 |
| Maltodextrin | 7.82 | 8.36 | 7.45 | 7.27 | 6.36 | |
| Sugar | 5.20 | 4.87 | 4.60 | 4.39 | 5.22 | |
| Colflo 67 | 0.21 | 0.22 | 0.20 | 0.19 | 0.21 | |
| Oat flakes | 0.81 | 0.76 | 0.72 | 0.68 | 0.73 | |
| Salt | 0.06 | 0.05 | 0.05 | 0.05 | 0.11 | 0.63 |
| Oat bran concentrate | 0.06 | 0.11 | 0.09 | 0.11 | 5.25 | |
| Barley pre-cooked | | | | 3.90 | | |
| Sago pre-cooked | | 5.43 | | | | |
| Pineapple pieces | | | 5.11 | | | |
| Mango pieces | | | | 4.88 | | |
| Almonds | | | | 0.98 | | |
| Cocoa powder | | | | | 1.58 | |
| Vanilla sugar | | | | | 0.65 | |
| Lemon juice | | | | | | 1.90 |
| Ascorbic acid | 0.02 | 0.03 | 0.02 | 0.02 | 0.03 | |

TABLE 2

| Nutritional profile of drinkable products (275 g portion) | Energy (Kcal) | Protein (g) | Fat (g) | Carbo-hydrates (g) | Dietary Fibre (g) | β-glucans (g) | Vit C (mg) |
|---|---|---|---|---|---|---|---|
| Strawberry | 247 | 3.6 | 3.4 | 49.4 | 3.8 | 0.82 | 52 |
| Apricot | 249 | 3.4 | 3.1 | 51.0 | 3.7 | 0.84 | 52 |
| Pineapple | 249 | 3.3 | 3.1 | 51 | 3.7 | 0.84 | 52 |
| Exotic fruit | 263 | 4.1 | 4.1 | 50.6 | 4.3 | 0.80 | 52 |
| Chocolate | 256 | 5.1 | 4.0 | 48.9 | 4.0 | 0.88 | 51 |

TABLE 3

Recipe for squeezable snacks - Pizza & Ham

| Base | | Filling | |
|---|---|---|---|
| Ingredient | % | Ingredient | % |
| Oat milk | 62.93 | Tomato cubes | 48.41 |
| Grissini | 25.69 | Ham cubes | 24.56 |
| Crackers | 8.05 | Onions | 15.51 |
| Oat bran conc. | 3.06 | Tomato puree | 4.83 |
| Salt | 0.27 | Olive oil | 2.24 |
| | | Garlic | 2.11 |
| | | Colflo-67 | 1.21 |
| | | Salt | 0.61 |
| | | Basil | 0.52 |
| Total | 100.00 | Total | 100.00 |

Final Product = 72 g base + 58 g filling

TABLE 4

Recipe for squeezable snacks - Mexican-type

| Base | | Filling | |
|---|---|---|---|
| Ingredient | % | Ingredient | % |
| Oat milk | 69.73 | Chicken cubes | 36.66 |
| Corn chips | 29.87 | Water | 18.36 |
| Salt | 0.40 | Red pepper | 13.77 |
| | | Red beans | 11.46 |
| | | Tomato paste | 6.87 |

TABLE 4-continued

Recipe for squeezable snacks - Mexican-type

| Base | | Filling | |
|---|---|---|---|
| Ingredient | % | Ingredient | % |
| | | Celery | 4.59 |
| | | Oil | 4.59 |
| | | Salt | 1.39 |
| | | Garlic | 1.39 |
| | | Colflo-67 | 0.28 |
| Total | 100.00 | Total | 100.00 |

Final Product = 72 g base + 58 g filling

TABLE 5

Recipe for squeezable snacks - Bulgur & Ratatouille

| Base | | Filling | |
|---|---|---|---|
| Ingredient | % | Ingredient | % |
| Oat milk | 53.70 | Tomato cubes | 40.32 |
| Water | 20.00 | Aubergine (20 × 20 mm) | 10.23 |
| Bulgur | 12.00 | Zucchini (10 × 10 × 10 mm) | 10.23 |
| Onions | 6.00 | Onions | 5.11 |
| Lentils | 5.00 | Red pepper | 5.11 |
| Maize oil | 3.00 | Green pepper | 5.11 |
| Salt | 0.25 | Celery | 3.41 |
| Mint | 0.05 | Garlic (3 × 3 mm) | 1.02 |

TABLE 5-continued

Recipe for squeezable snacks - Bulgur & Ratatouille

| Base | | Filling | |
|---|---|---|---|
| Ingredient | % | Ingredient | % |
| | | Garlic extract | 0.07 |
| | | Olive oil | 1.36 |
| | | Salt | 1.09 |
| | | Black pepper | 0.07 |
| | | Rosemary extract | 0.03 |
| | | Parsley frozen | 1.85 |
| | | Basil IQF 1–5 mm | 0.85 |
| | | Sugar | 0.17 |
| | | Bay leave extract | 0.03 |
| | | Lamb 10 mm cubes | 24.00 |
| Total | 100.00 | Total | 100.00 |

Final Product = 72 g base + 58 g filling

TABLE 6

Recipe for squeezable snacks - Potato + meat sauce

| Base | | Filling | |
|---|---|---|---|
| Ingredient | % | Ingredient | % |
| Oat milk | 82.65 | Water | 44.37 |
| Potato flakes | 16.53 | Fried beef mince | 12.72 |
| Salt | 0.82 | Tomato cubes | 15.66 |
| | | Onion | 5.48 |
| | | Tomato puree | 3.29 |
| | | Chopped tomatoes | 4.70 |
| | | Gouda/parmesan | 0.27 |
| | | Carrots 10 × 10 × 10 mm | 4.11 |
| | | Celery | 4.11 |
| | | Rape seed oil | 1.37 |
| | | Aroma 4BE/K | 0.27 |
| | | Colfol-67 | 1.37 |
| | | Garlic 3 × 3 mm | 0.24 |
| | | Salt | 0.73 |
| | | Thyme extract | 0.01 |
| | | Black pepper Extr. | 0.03 |
| | | Basil extract | 0.06 |
| | | White pepper Extr. | 0.10 |
| | | Oregano | 0.66 |
| | | Sugar | 0.34 |
| | | Wheat flour | 0.65 |
| | | Basil IQF 1–5 mm | 0.10 |
| Total | 100.00 | Total | 100.00 |

Final Product = 72 g base + 58 g filling

TABLE 7

Recipe for squeezable snacks - Cookies + Marmalade

| Base | | Filling | |
|---|---|---|---|
| Ingredient | % | Ingredient | % |
| Oat milk | 41.70 | Marmalade | 51.64 |
| Danish cookies | 45.84 | Water | 22.42 |
| Whey protein conc | 8.32 | Apricot dried | 15.51 |
| Oat bran conc. | 4.14 | Plums dried | 8.12 |
| | | Colflo-67 | 2.24 |
| | | Ascorbic acid | 0.07 |
| Total | 100.00 | Total | 100.00 |

Final Product = 72 g base + 58 g filling

TABLE 8

Recipe for squeezable snacks - Pineapple pie

| Base | | Filling | |
|---|---|---|---|
| Ingredient | % | Ingredient | % |
| Oat milk | 37.97 | Pineapple puree | 28.50 |
| Danish cookies | 37.97 | Pineapple pieces | 61.07 |
| Barley pre-cooked | 16.46 | Sugar | 8.14 |
| Oat flakes | 5.06 | Colflo-67 | 2.45 |
| Almonds | 2.53 | | |
| Total | 100.00 | Total | 100.00 |

Final Product = 72 g base + 58 g filling

TABLE 9

Nutritional profile of squeezable snacks (Pizza & Ham and Cookies & Marmalade - 130 g portion)

| | Energy (Kcal) | Protein (g) | Fat (g) | Carbohy-drates(g) | Dietary Fibre(g) | β-glucans (g) |
|---|---|---|---|---|---|---|
| Pizza & Ham | 170 | 7.1 | 5.9 | 22.7 | 2.4 | 0.67 |
| Cookies & Marmalade | 322 | 7.1 | 10.4 | 49.5 | 3.8 | 0.78 |

What is claimed is:

1. An article of manufacture comprising a squeezable food product and a packaging unit for storing and consuming of the food product, wherein the squeezable food product comprises (a) a first food component forming a cereal-based component and (b) a second food component forming a filling component having a pH lower than the first food component and a water content that is higher than the first food component; and wherein the packaging unit comprises a supple pouch having a main external squeezable body and at least one partition layer which divides the squeezable body into at least two separate cavities with the first and second food components being separately stored in different cavities such that the first and second food components can be simultaneously extruded out of the packaging unit at an extrusion rate of the first component relative to the second component of from about 1:1 to 1:3 without the first and second components significantly mixing together by exerting pressure upon the extrudable body, with the first food component and the second food component forming a combinable food product upon consumption.

2. The article of claim 1, wherein the first food component is in a liquid or semi-solid form and comprises a cereal-based component.

3. The article of claim 2, wherein the first food component comprises bread, corn-chips, cookies, cereal flakes, cereal flour, rice, or lentils, or a mixture thereof.

4. The article of claim 2, wherein the cereal based component comprises potatoes or other vegetables.

5. The article of claim 2, wherein the first food component includes a source of beta-glucan that provides at least 0.65 grams of beta-glucan in the first food component.

6. The article of claim 1, wherein the first food component further comprises oat milk.

7. The article of claim 6, wherein the oat milk comprises between about 35% and about 85% by weight of the first food component.

8. The article of claim 1, wherein the second food component is a sauce, vegetable, fruit puree, fruit pieces, spicy blends, a ratatouille, or combination thereof.

9. The article of claim 1, wherein the food product provides nutrient density with less than 30% of the energy being provided by fat.

10. The article of claim 1, wherein the food product is fortified with vitamins or minerals.

11. The article of claim 1, wherein the packaging unit is openable along an opening line which encompasses a portion of both the first and second cavities.

12. The article of claim 11, having a narrowed portion where the opening line is located so that the first and second food components can be discharged in contact with each other from an opening created by the opening line.

13. The article of claim 1, wherein the second food component comprises solid particles of meat, vegetable or fruit having a particle size of about 5 mm or less.

* * * * *